US009458557B2

(12) United States Patent
Inada et al.

(10) Patent No.: US 9,458,557 B2
(45) Date of Patent: Oct. 4, 2016

(54) METHOD FOR MANUFACTURING SYNTHETIC FIBER

(71) Applicant: Mitsubishi Rayon Co., Ltd., Tokyo (JP)

(72) Inventors: Hiromasa Inada, Hiroshima (JP); Tomotaka Yoshimori, Hirsoshima (JP); Hiroshi Hashimoto, Hiroshima (JP); Atsushi Kawamura, Hiroshima (JP); Kazuma Okumura, Hiroshima (JP)

(73) Assignee: Mitsubishi Rayon Co., Ltd., Tokyo (JP)

( * ) Notice: Subject to any disclaimer, the term of this patent is extended or adjusted under 35 U.S.C. 154(b) by 170 days.

(21) Appl. No.: 14/346,982

(22) PCT Filed: Sep. 24, 2012

(86) PCT No.: PCT/JP2012/074392

§ 371 (c)(1),
(2) Date: Mar. 25, 2014

(87) PCT Pub. No.: WO2013/047437

PCT Pub. Date: Apr. 4, 2013

(65) Prior Publication Data

US 2014/0232036 A1 Aug. 21, 2014

(30) Foreign Application Priority Data

Sep. 26, 2011 (JP) ..... 2011-208911

(51) Int. Cl.

| | |
|---|---|
| ***D01D 11/00*** | (2006.01) |
| ***D01D 13/00*** | (2006.01) |
| ***D01D 13/02*** | (2006.01) |
| ***D01F 11/00*** | (2006.01) |
| ***D01D 5/06*** | (2006.01) |
| ***D01D 5/04*** | (2006.01) |
| *D01F 9/22* | (2006.01) |

(52) U.S. Cl.
CPC ..... *D01F 11/00* (2013.01); *D01D 5/04* (2013.01); *D01D 5/06* (2013.01); *D01F 9/22* (2013.01)

(58) Field of Classification Search
CPC ..... D01D 5/06; D01D 11/00; D01D 13/00; D01D 13/02
USPC ..... 264/178 F, 178 R, 179–203
See application file for complete search history.

(56) References Cited

FOREIGN PATENT DOCUMENTS

| | | | | |
|---|---|---|---|---|
| JP | 60259612 A | * 12/1985 | ..... | D01D 5/06 |
| JP | 1-183511 | 7/1989 | | |

(Continued)

*Primary Examiner* — Leo B Tentoni
(74) *Attorney, Agent, or Firm* — Morgan, Lewis & Bockius LLP

(57) ABSTRACT

There is provided a dry-wet spinning device for an acrylic precursor fiber bundle for manufacturing carbon fibers, the device enabling stable spinning by making the coagulability of spun yarn (2) uniform by suppressing the vibration of the coagulating liquid surface to make the spun yarn (2) spun downward from a spinneret (1) without the liquid surface being in contact with the spinning surface of the spinneret less susceptible to an accompanying flow reflected by the bottom surface of a spinning bath. To this end, in the present invention, a horizontal flow straightening plate (8) produced from a porous plate or a plate material extending in the direction approximately perpendicular to the direction in which the spun yarn (2) is spun is disposed in a coagulation bath so as to surround the circumference of the yarn spun downward from the spinneret (1). Further, a vertical flow straightening plate (9) extending vertically across part or all of the outer periphery of the horizontal flow straightening plate (8) can be provided.

14 Claims, 15 Drawing Sheets

(56) References Cited

FOREIGN PATENT DOCUMENTS

| | | |
|---|---|---|
| JP | 7-207522 | 8/1995 |
| JP | 8-113817 | 5/1996 |
| JP | 11-350244 | 12/1999 |
| JP | 11-350245 | 12/1999 |
| JP | 2006-118087 | 5/2006 |
| JP | 2007-291594 | 11/2007 |

* cited by examiner

METHOD FOR MANUFACTURING SYNTHETIC FIBER

TECHNICAL FIELD

The present invention relates to a dry-wet spinning device and a method for manufacturing a synthetic fiber using the dry-wet spinning device. More specifically, it relates to a dry-wet spinning device useful for manufacturing an acrylic precursor fiber bundle for manufacturing carbon fibers.

BACKGROUND ART

According to a dry-wet spinning method, a polymer solution (that is, stock solution for spinning) is firstly discharged from a spinning hole of a spinneret to a vapor phase part (generally, in air) for forming fibers, which are then coagulated by introduction to a coagulation bath, and subsequently the fibers are taken up from the coagulation bath to form a fiber bundle. According to the dry-wet spinning method, since the fiber draft generated by taking up of fibers is concentrated on a vapor phase part, it is possible to achieve coagulation·gellation of fiber under low tension in a coagulation bath. Accordingly, a fiber bundle having an excellent extension property at post process can be obtained. According to the dry-wet spinning method, a fiber bundle consisting of staple fiber having excellent densification can be obtained.

Meanwhile, there is a need for reducing the cost for manufacturing a carbon fiber bundle. As one method to meet such need, there is an improvement of productivity of an acrylic fiber bundle that is required for manufacturing a carbon fiber bundle. For the improvement of productivity, it would be necessary to have high speed spinning and high density spinning (that is, having many spinning holes on a spinneret) of an acrylic fiber bundle.

However, in case of high speed spinning, as the running speed of a fiber bundle passing through a coagulation bath is increased, the flow amount of coagulating liquid which flows accompanying the travel of a fiber bundle is increased. According to an increased accompanying flow, the flow amount of a coagulating liquid is further increased in the coagulation bath, and as a result, the liquid surface of a coagulating liquid is swollen and sometimes a phenomenon of having whirlpool occurs. When such phenomenon occurs, liquid surface vibration of the coagulating liquid that is present right below the spinneret is increased. The liquid surface vibration of a coagulating liquid causes a disturbance in arrangement of staple fibers or yarn breakage of staple fibers in a fiber bundle. When the liquid surface vibration of a coagulating liquid is significant, part or all of the surface (spinneret surface) on which spinning holes of a spinneret are arranged may be in contact with the coagulating liquid, making it impossible to carry out dry-wet spinning.

For high density spinning, that is, in case of having many spinning holes on a spinneret, when distance between adjacent spinning holes is reduced to have many holes and liquid surface vibration of the coagulating liquid is high, a phenomenon of having neighboring staple fibers adhered to each other is caused while a fiber spun from the spinning hole firstly passes through a vapor phase part, that is, before the fiber is coagulated.

To solve such problems, for example, in JP 1-183511 A (Patent Document 1), a device equipped with a straightening pipe for surrounding running yarn is disclosed. It is also described that the top surface of the straightening pipe needs to be exposed above the liquid surface. In JP 7-207522 A (Patent Document 2), plural pieces of straightening plates or a waviness preventing plate composed of a porous plate are disposed vertically between a spinneret and a coagulation bath wall, which is opposite to the take-up direction of spun yarn, or between a spinneret and a guide on take-up side of a coagulation bath. In that case, similar to Patent Document 1, the top part of a straightening plate or a waviness preventing plate is also exposed above the liquid surface.

Further, in JP 11-350245 A (Patent Document 3), a method of controlling waviness on liquid surface of coagulation bath by floating a ball on the liquid surface of coagulation bath in an area below the outer periphery of a spinneret is suggested. Further, in JP 2007-291594 A (Patent Document 4), a method of installing a partition plate at a distance from a yarn within a range of 20 to 200 nm in a coagulation bath which follows a yarn during the passage of downward running in the coagulation bath via a funnel-shape straightening plate, turning back with the direction changing guide, and then guided to a guide on take-up side is disclosed.

CITATION LIST

Patent Document

Patent Document 1: JP 1-183511 A
Patent Document 2: JP 7-207522 A
Patent Document 3: JP 11-350245 A
Patent Document 4: JP 2007-291594 A

SUMMARY OF THE INVENTION

Problem to be Solved by the Invention

However, according to the methods disclosed in Patent Documents 1, 2 and 3, the accompanying flow which accompanies with running of fiber collides on a bottom surface of a coagulation bath, and due to a counter-current and liquid surface vibration as a rebound, none of them were sufficient for suppressing disturbances in arrangement of staple fiber or a thread breakage of staple fibers in a fiber bundle. Further, according to the method described in Patent Document 4, a yarn may be in contact with a partition plate when the distance between yarn and partition plate is excessively short, and it becomes a reason for lowering workability as caused by breakage of staple fiber. On the other hand, when the distance between yarn and partition plate is excessively long, there are problems that the function of a partition plate is diminished as the distance between yarn and partition plate is too long and the effect is lowered as the fiber is easily susceptible to a disturbance in bath liquid.

An object of the present invention is to provide a dry-wet spinning device which is particularly useful for manufacturing an acrylic precursor fiber bundle for manufacturing carbon fibers, in which the device enables stable spinning by making the coagulability of spun yarn uniform by suppressing the vibration of a coagulating liquid surface to make the spun yarn spun downward from a spinneret without the liquid surface being in contact with the spinning surface of the spinneret less susceptible to an accompanying flow reflected by the bottom surface of a spinning bath.

Means for Solving Problem

The dry-wet spinning device of the present invention is a dry-wet spinning device having a spinneret and a coagulation bath, and has a horizontal flow straightening plate made of a plate that is disposed in a coagulation bath so as to surround part or all of the circumference of the yarn spun downward from the spinneret.

The horizontal flow straightening plate consists of a single piece or plural pieces of plates and has an opening part for passing the yarn at the center. A range of 50% or more of the circumference of the yarn is surrounded by the horizontal flow straightening plate.

Further, by forming a connecting part on the horizontal flow straightening plate, the opening part can be connected to an outside of the horizontal flow straightening plate and each of the opening formed by the connecting part is in a range of 20% or less of the outer periphery of the opening part.

According to a preferred embodiment, the angle formed by a surface of the horizontal flow straightening plate and a horizontal surface in the outward direction from a coagulation bath is preferably 75 degrees or less. For the horizontal flow straightening plate, the width in a vertical direction relative to the main axis of a yarn transported downward is preferably 5 mm or more. It is preferable that part or all of the horizontal flow straightening plate extend to the wall surface of the coagulation bath. It is also preferable that the end part of the horizontal flow straightening plate close to yarn is installed below the liquid surface. It is preferable that the distance between the end part of the horizontal flow straightening plate close to yarn and the yarn is 5 mm or more but 100 mm or less. When the horizontal flow straightening plate is a porous plate, it is preferable that the opening ratio is 5% or higher but 95% or lower and the hole diameter is 0.5 mm or more but 50 mm or less. Further, the horizontal flow straightening plate may be an iron mesh, and the mesh size may be 2 mesh or higher but 800 mesh or lower for such case.

It is preferable to have a vertical flow straightening plate made of a plate extending in an upward direction to the liquid surface on part or all of the outer periphery of the horizontal flow straightening plate made of a plate. Alternatively, it is also possible to have a vertical flow straightening plate made of a plate extending not only in an upward direction above the liquid surface but also in a downward direction of the liquid surface on part or all of the outer periphery of the horizontal flow straightening plate made of a plate. The vertical flow straightening plate may be a porous plate, and in such case, the vertical flow straightening plate is a punched metal, and it preferably has an opening ratio of 5 to 95% and a hole diameter of 0.5 mm or more but 50 mm or less. The vertical flow straightening plate may be also a wire mesh, and in such case, the mesh size is preferably 2 mesh or more but 800 mesh or less. It is also possible that the horizontal flow straightening plate made of a plate or the vertically extending vertical flow straightening plate is mountable and also detachable.

The method for manufacturing a synthetic fiber of the present invention is a method for manufacturing a synthetic fiber by spinning synthetic fiber using the aforementioned dry-wet spinning device.

Effect of the Invention

According to the present invention, stable spinning can be achieved by effectively suppressing the vibration of a coagulating liquid surface or disturbances of a coagulating liquid flow, which is accompanied with a reflecting flow flowing counter-currently toward the coagulating liquid surface as the accompanying flow accompanying the running of a yarn is reflected by the bottom surface.

BEST MODE(S) FOR CARRYING OUT THE INVENTION

Hereinbelow, the most representative embodiment of the dry spinning device of the present invention will be described in detail based on the drawings.

Figure 1:
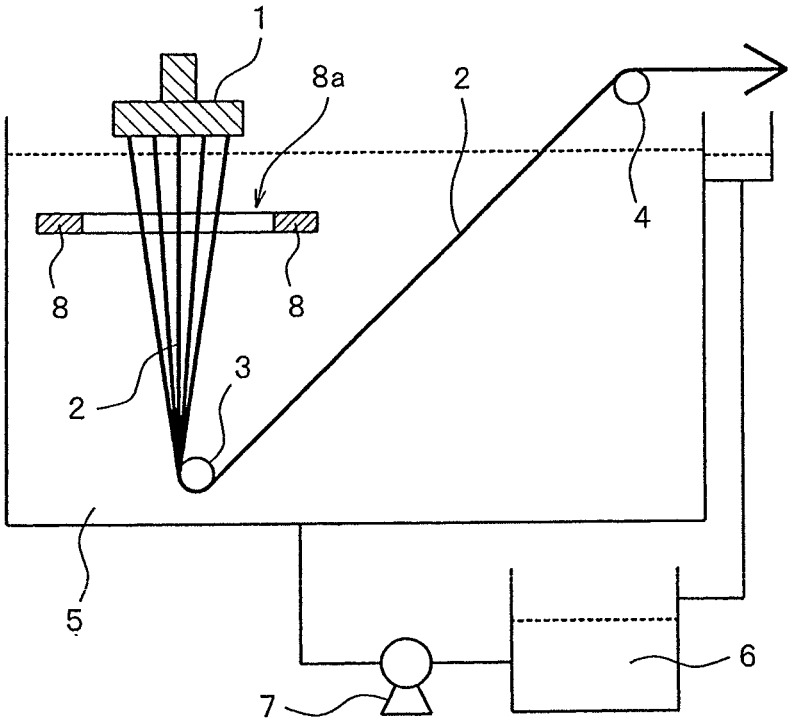
FIG. 1 is a side sectional view schematically illustrating an example of one embodiment of the dry-wet spinning device according to the present invention.

FIG. 1 illustrates one embodiment of the dry-wet spinning device according to the present invention. In the drawing, the numeral 1 represents a spinneret, 2 represents a spun yarn, 3 represents a direction changing guide in a coagulation bath, 4 represents a taking-up side guide, 5 represents a coagulation bath, 6 represents a bath for receiving coagulation discharge, 7 represents a circulation pump, 8 represents a horizontal flow straightening plate, and 8*a* represents an opening part.

The two embodiments illustrated in FIGS. 1 to 4 have the simplest constitution of the present invention. In the embodiment illustrated in FIG. 1, the yarn 2 consisting of plural filament bundles spun from the spinneret 1 runs downward in a coagulation bath, and as the running direction is changed by the direction changing guide 3 disposed close to a bottom surface of the coagulation bath 5, it runs along the slope toward the taking-up side guide 4 that is disposed above the liquid surface near the top end of a side wall, which is present in a position remotest from the spinneret 1 of the coagulation bath 5, and is horizontally delivered to the next step with an aid of the same taking-up side guide 4.

Figure 2:
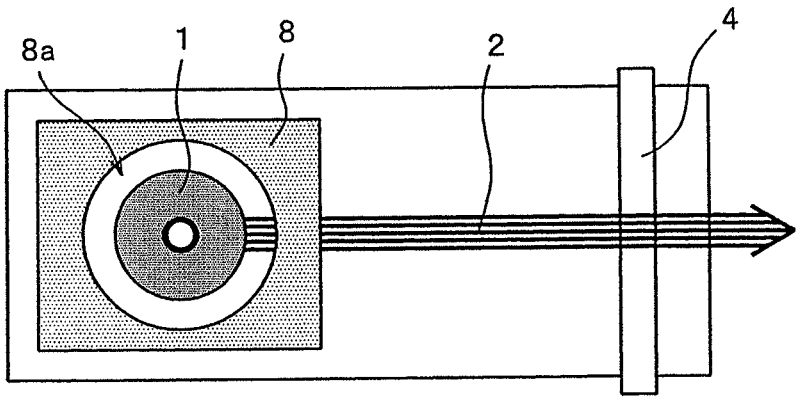
FIG. 2 is a schematic plane view of the embodiment illustrated in FIG. 1.

According to this embodiment, the horizontal flow straightening plate 8 having the opening part 8*a* for surrounding, in a coagulation bath, the middle of the running yarn 2 spun from the spinneret 1 is disposed horizontally. In the present invention, the horizontal flow straightening plate 8 is disposed on a cross section approximately perpendicular to the direction for spinning the yarn 2 such that it can surround the spun yarn 2, and it consists of a porous plate having openings on a running plane of the yarn 2 or a plate material without holes. The shape of the opening part 8*a* may have a circular cross section as illustrated in FIG. 2, or may have a polygonal cross section. The horizontal flow straightening plate 8 is one of the most characteristic constitutional members of the present invention.

As illustrated in FIGS. 1 and 2, the horizontal flow straightening plate 8 includes a non-illustrated supporting member and is supported and fixed in the coagulation bath. As a result, since there is no special interfering member present between the outer periphery of the horizontal flow straightening plate 8 and the inner wall of the coagulation bath 5, the coagulating liquid can freely flow between the outer periphery of the horizontal flow straightening plate 8 and the inner wall of the coagulation bath 5. Meanwhile, according to the embodiments illustrated in FIGS. 3 and 4, the outer periphery of the horizontal flow straightening plate 8 on the taking-up side guide 4 side is maintained free while other outer periphery is extended to the inner side wall of the coagulation bath 5.

With such constitution, the accompanying flow of a coagulating liquid, which is generated according to running of the yarn 2 spun from the spinneret 1 of the embodiment, collides with a bottom surface of the coagulation bath 5, flows to the inner surface of the side wall of the coagulation bath 5, and flows upward along the same inner surface as a counter current. If the horizontal flow straightening plate 8 is not present at that time, the accompanying flow and the counter current would collide with each other to yield turbulence, and thus vibration of the coagulating liquid surface accompanied with the accompanying flow on liquid surface is caused, the spinneret is brought into contact with the coagulating liquid, or staple fibers spun from the spinneret 1 are adhered to each other to cause a problem in stable fiber manufacturing.

Figure 5:
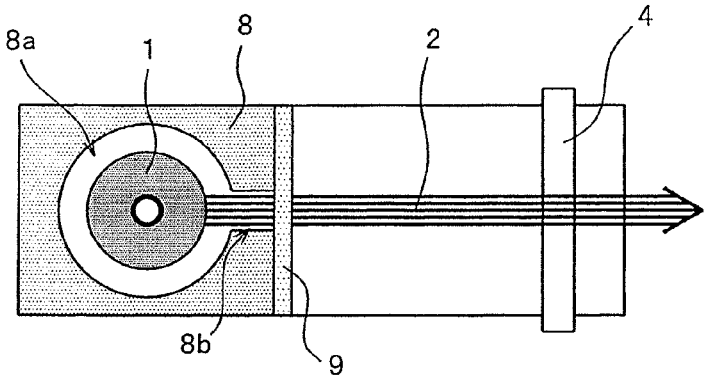
FIG. 5 is a plane view schematically illustrating one example of an additional embodiment of the present invention.
Figure 6:
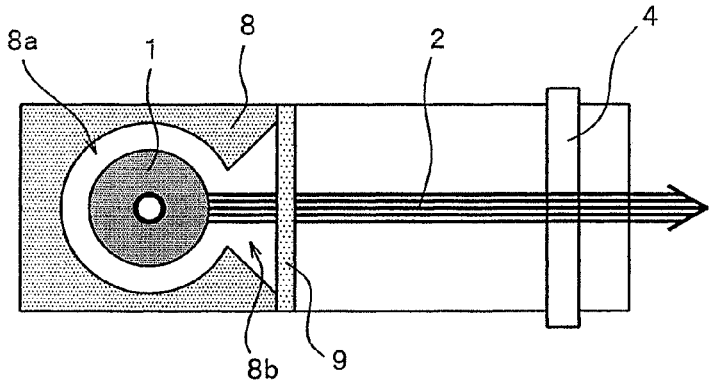
FIG. 6 is a plane view schematically illustrating one example of an additional embodiment of the present invention.
Figure 7:
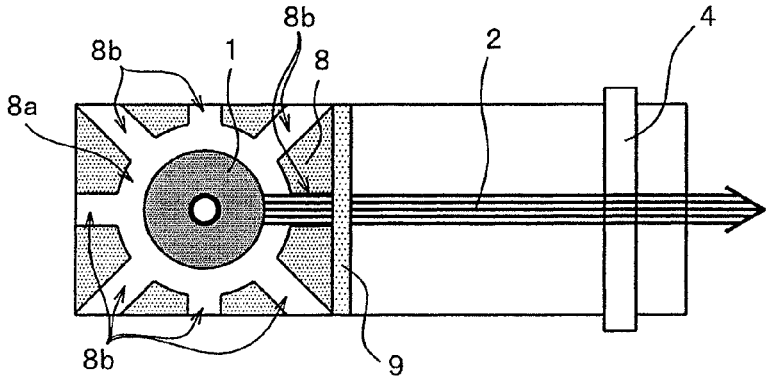
FIG. 7 is a plane view schematically illustrating one example of an additional embodiment of the present invention.

Three embodiments illustrated in FIGS. 5 to 7 are an example in which the opening part 8*a* present at the center of the horizontal flow straightening plate 8 is connected to an outside via the connecting part 8*b*, and thus 50% or more range of the circumference of the yarn is surrounded by the horizontal flow straightening plate 8 and each opening formed by the connecting part 8*b* corresponds to less than or equal to 20% of the outer periphery portion of the opening part 8*a*.

When the circumference of the yarn surrounded by the horizontal flow straightening plate 8 is in the range of 50% or more but less than 80%, the horizontal flow straightening plate 8 consists of plural pieces of plates and each opening corresponds to less than or equal to 20% of the outer periphery portion of the opening part 8*a*.

When the horizontal flow straightening plate 8 consists of plural pieces of plates, each plate may have the same shape or a different shape.

When the range of the circumference of the yarn surrounded by the horizontal flow straightening plate 8 is equal to or more than 80%, it is preferable from the viewpoint of suppressing liquid surface vibration or having a simple structure as the horizontal flow straightening plate can be made of a single piece of a plate. More preferably, it is 100%.

According to the present embodiment, the horizontal flow straightening plate 8 described above is disposed right underneath the spinneret 1 so that the accompanying flow and the reflecting flow cancel each other and simultaneously the mixed flow moving in upward direction is blocked by the horizontal flow straightening plate 8 and flows to the outer periphery of the horizontal flow straightening plate 8. As a result, it is unlikely for the coagulating liquid near the spinneret hardly to have a vibration and a contact between the spinneret 1 and the coagulating liquid is prevented, enabling stable spinning. In the embodiment illustrated in FIGS. 3 and 4, in particular, a turbulence moving upward from the lower side is completely blocked by the horizontal flow straightening plate 8, and thus no vibration on the liquid surface is caused near the lower side of the spinneret 1, making it possible to have more stable spinning.

The angle formed by a surface of the horizontal flow straightening plate 8 and a horizontal surface in the outward direction from coagulation bath is preferably 75 degrees or less. With such angle, speed of the reflecting flow can be easily lowered or dispersed, and as a result, the vibration of the liquid surface can be reduced. The angle is more preferably 50 degrees or less, and even more preferably 30 degrees or less.

The width dimension in the horizontal direction of a plate for forming the horizontal flow straightening plate 8 (hereinbelow, simply referred to as a horizontal width dimension) is defined as follows. The "horizontal width dimension of a plate for forming the horizontal flow straightening plate 8" is "the shortest distance (A) between the main axis of the spun yarn and the outer periphery of the plate after subtracting the shortest distance (B) between the main axis of the spun yarn and the outer periphery of the opening part 8*a* within a perpendicular plane in the same direction, with the proviso that, when the connecting part 8*b* is present in the perpendicular plane, the calculation is made based on an assumption that the connecting part 8*b* is a plate for forming the horizontal flow straightening plate 8."

With regard to the horizontal width dimension of a plate for forming the horizontal flow straightening plate 8, in order to easily lower and disperse the speed of the reflecting flow which reflects by the bottom surface of the coagulation bath 5 and flows in a direction opposite to the spinning direction, that is, flows counter-currently toward the coagulating liquid surface of the coagulation bath 5 along the side wall surface of the coagulating bath 5, the width dimension is preferably 5 mm or more. To have a more uniform straightening effect, it is preferably 10 mm or more. Meanwhile, the horizontal width dimension of a plate is not particularly limited, and it can be suitably set depending on a size of the coagulation bath 5.

The plate for forming the horizontal flow straightening plate 8 has an opening on a running plane of the yarn 2, and in order to suppress the accompanying flow which flows counter-currently along the side wall surface of the coagulation bath 5, it is preferably extended to the inner surface of the side wall of the coagulation bath 5 excluding the direction of taking up the yarn 2 as described above.

With regard to the longitudinal position for installing a plate for forming the horizontal flow straightening plate 8, in order to easily reduce and disperse the accompanying flow, which reflects by the bottom surface of the coagulation bath 5 and flows in a direction opposite to the spinning direction of the spun yarn 2, that is, flows counter-currently toward the coagulating liquid surface of along the side wall surface of the coagulating bath 5, before reaching the liquid surface of the coagulating liquid, the installation is preferably made at a position which is deeper than 0 mm in depth direction when the liquid surface height of the coagulation bath is taken as a zero point. Further, within a depth of 500 mm from the liquid surface, the speed of the accompanying flow flowing counter-currently can be further lowered and dispersed to suppress the impact of the vibration of the liquid surface, and therefore more desirable. Further, for maintaining a suitable distance between the yarn 2 and a plate for forming the horizontal flow straightening plate 8 and reduce the vibration of the liquid surface by further lowering and dispersing the speed of the accompanying flow flowing counter-currently, the installation is made at a position which is preferably in the range of between 10 mm or more but 200 mm or less, or more preferably in the range of 50 mm or more but 150 mm less in depth direction.

Further, it is preferable that the shortest distance between the plate for forming the horizontal flow straightening plate 8 and the yarn 2 be at least 5 mm or more in order to prevent damage on fiber caused by contact between them. Further, when the shortest distance between the horizontal flow straightening plate 8 and the yarn 2 is 100 mm or less, the accompanying flow flowing counter-currently toward the liquid surface of the coagulating liquid can be effectively reduced and dispersed to lower the vibration of the liquid surface, and therefore desirable. Meanwhile, in the present invention, the shortest distance between the horizontal flow straightening plate 8 and the yarn 2 is preferably 10 mm to 50 mm from the viewpoint of avoiding a contact between them and straightening the counter-currently flowing accompanying flow.

The plate for forming the horizontal flow straightening plate 8 can be either a plate material with no holes or a porous plate. However, from the viewpoint of reducing the movement of reflective flow, it is preferably a porous plate. As for the porous plate, a punched metal or a wire mesh is preferably used.

When a punched metal is used as a porous plate, the speed of the accompanying flow flowing counter-currently can be reduced and dispersed compared to a plate material with no holes, and thus the opening ratio is preferably 5% or higher. Further, when the opening ratio is 95% or lower, the effect of suppressing the vibration of the liquid surface can be obtained compared to a case in which a punched metal is not installed, and therefore desirable. To have even more uniform straightening effect, it is preferable to have the opening ratio of 20% or higher but 70% or lower. The hole diameter is preferably set in the range of from 0.5 mm to 50 mm. It is more preferably 1 mm or more but 10 mm or less.

When a wire mesh is used as a porous plate for forming the horizontal flow straightening plate 8, the speed of the accompanying flow flowing counter-currently can be more easily reduced and dispersed compared to a plate material with no holes, similar to a case of using a punched metal. The mesh size of a wire mesh is preferably 800 mesh or less. Further, when it is 2 mesh or more, the effect of suppressing the vibration of the liquid surface can be obtained compared to a case in which a wire mesh is not installed. To have even more uniform straightening effect, it is more preferably 10 mesh or more but 400 mesh or less. It is even more preferably 20 mesh or more but 200 mesh or less.

Examples of the porous plate for forming the horizontal flow straightening plate 8 include a punched metal and a wire mesh as described above. However, it is not limited to them as long as it is a porous material having shape maintainability. Examples of the material of the horizontal flow straightening plate 8 include a metal represented by stainless and plastic, but not limited thereto. The thickness of the horizontal flow straightening plate 8 is preferably about 0.5 mm or more but 30 mm or less so as to have both shape maintainability and handlability. Further, in order to have convenient mounting and detachment in a coagulation bath, the horizontal flow straightening plate 8 may have a bi-sectionally divided structure when viewed from the top of the coagulation bath.

According to the present invention, the vertical flow straightening plate 9 disposed between the spinneret 1 and the taking-up side guide 4, which is disposed on the yarn taking-up side, and extended in a longitudinal direction in the coagulation bath is, as illustrated in FIGS. 8 to 11, either extended in an upward direction from part of the outer periphery of a plate for forming the horizontal flow straightening plate 8 to the liquid surface or similarly extended in an upward direction from part of the outer periphery of a plate for forming the horizontal flow straightening plate 8 to the liquid surface and also in a downward direction toward the bottom surface. Meanwhile, the remaining of the outer periphery of the horizontal flow straightening plate 8 in which the vertical flow straightening plate 9 is not included is installed such that it can be extended to an inner surface of the side wall of the coagulation bath 5, except that the outer periphery in the direction in which the yarn 2 is taken-up via the taking-up side guide 4 after the running direction is changed by the direction changing guide 3 in the coagulation bath.

Further, as illustrated in FIGS. 12 to 15, the vertical flow straightening plate 9 of the present invention is installed such that it can surround the yarn 2 in approximately parallel direction to the spinning direction of the yarn 2, which is spun downward from the spinneret, and it is extended in an upward direction from the outer periphery of a plate as the horizontal flow straightening plate 8 to the liquid surface or similarly extended in an upward direction from the outer periphery of the horizontal flow straightening plate 8 to the liquid surface and also in a downward direction toward the bottom surface.

When a punched metal is used as the vertical flow straightening plate 9, in order to have a straightening effect by suppressing the accompanying flow toward the taking-up side guide 4 or the exhibition of other factors for causing the vibration of the liquid surface, the opening ratio is preferably 5% or higher but 95% or lower. To have even more uniform straightening effect, the opening ratio is more preferably 20% or higher but 70% or lower. The hole diameter is preferably 0.5 mm or more but 50 mm less. It is more preferably 1 mm or more but 10 mm or less.

When a wire mesh is used as the vertical flow straightening plate 9, in order to have a straightening effect by suppressing the accompanying flow toward the taking-up side guide or the exhibition of other factors for causing the vibration of the liquid surface, like the case of using a punched metal, it is preferably 2 mesh or more but 800 mesh or less. In order to have even more uniform straightening effect, it is more preferably 10 mesh or more but 400 mesh or less. It is even more preferably 20 mesh or more but 200 mesh or less.

The vertical flow straightening plate 9 may be a either a porous material or a plate with no holes. Examples of the porous material include a punched metal and a wire mesh. However, it is not limited to them as long as it is a plate material or a cylinder shape member made of a porous material having shape maintainability. Examples of the material of the plate material or cylinder shape member include a metal and plastic, but not limited thereto. The configuration is not limited either, and for example, the upper part of the vertical flow straightening plate 9 is formed of a plate member and the lower part is formed of a wire mesh or the upper part is formed of a punched metal and the lower part is formed of a plate member. The cross-sectional shape of the vertical flow straightening plate 9 seen from above the coagulation bath 5 may be a circular cross-section, an elliptical cross-section, an arc cross-section, or a polygonal cross-section.

The accompanying flow accompanied with running of spun yarn from right underneath the spinneret 1 to a lower side is reflected by the bottom surface of the coagulation bath 5 and flows in a direction opposite to the running direction of the spun yarn, that is, flows counter-currently toward the liquid surface of the coagulation bath, along the side wall surface of the coagulating bath 5. When the flow is strong, vibration of the liquid surface is caused, and as a result, troubles like fiber breakage or adhesion between fibers are yielded. By installing the horizontal flow straightening plate 8 to suppress them, the speed of the liquid flow flowing in a direction opposite to the spinning direction of the spun yarn 2 is reduced and dispersed, yielding an effect of significantly suppressing the vibration of the liquid surface compared to a case of a related art in which only a vertical flow straightening plate is installed. Further, by combining the horizontal flow straightening plate with the vertical flow straightening plate, factors for causing the vibration of the liquid surface other than the accompanying flow accompanied with running of the yarn 2, for example, the vibration of the liquid surface from the direction of the taking-up side guide 4, can be also easily suppressed, and thus more effective.

By using the dry-wet spinning device of the present invention, the vibration of liquid surface in a coagulation bath is reduced so that it becomes possible to spin synthetic fiber with little adhesion between staple fibers.

Because the vibration of a liquid surface is high when the number of holes in a nozzle used for one nozzle pack is increased, in particular, it is effective for using a nozzle having a large number of nozzle holes. The number of holes is preferably 5000 or less and more preferably 4000 or less.

When it is 5000 or less, the vibration of a liquid surface can be easily reduced.

The lower limit of the number of holes is not particularly limited. However, when the number of holes is 2500 or more, the vibration of a liquid surface becomes higher, and thus the dry-wet spinning device of the present invention can be preferably used.

Next, the present invention will be described in more detail with reference to Examples.

(Evaluation of Vibration of Liquid Surface)

The surface of a coagulating liquid was observed with a naked eye and the vibration of the liquid surface near the region in which the yarn was introduced to the liquid surface was evaluated.

◉: there is very little vibration of liquid surface, ○: there is little vibration of liquid surface, X: there is huge vibration of liquid surface (Presence or Absence of Staple Fiber Adhesion Exhibited Under Electron Microscope)

With regard to the observation by an electron microscope, the cross-section of a fiber bundle obtained as a drawn yarn was observed under a scanning electron microscope (Trade name: XL20, manufactured by Philips Electronics Optics) with magnification of ×1000 to see the presence or absence of adhesion. Meanwhile, the number of the staple fibers determined for the presence or absence of adhesion was 400.

(Number of Staple Fiber Adhesion According to Dispersion Test)

For the dispersion test, a fiber bundle having 3000 staple fibers cut to have a length of 3 mm was introduced to a beaker which has been added with 200 ml acetones, and stirred for 10 minutes with a magnetic stirrer. After that, the liquid was transferred to a glass petri dish underlaid with black paper and the adhered fibers were counted while applying a light from the above.

(Maximum Flow Rate on Coagulating Liquid Surface Based on Numerical Analysis)

By using a numerical analysis tool (manufacturer: ANSYS Japan K.K., software for analysis: FLUENT), a steady-state fluid analysis was performed for the fluid state of a coagulated yarn in the coagulation bath.

EXAMPLE 1

A polymer consisting of 96% by mass of acrylonitrile, 1% by mass of methacrylic acid, and 3% by mass of methyl acrylate with extreme viscosity [η] of 1.8 was dissolved in dimethyl acetamide to prepare a stock solution for spinning in which the polymer concentration is 23% by mass. The stock solution for spinning was filtered through a 20μ and 5μ filter, kept at 70° C., and then spun according to the dry-wet spinning method by using a spinneret with a diameter of 0.15 mm and 3000 holes and the device illustrated in FIGS. 12 and 13 to obtain a coagulated fiber. The stock solution for spinning was introduced to the coagulation bath while composition of the coagulation bath was dimethyl acetamide/water=78/22 (% by mass), a temperature was 15° C., and the distance between the nozzle surface and the coagulation bath was 4 mm.

The obtained coagulated fiber was drawn in air, subsequently subjected to a drawing washing in hot water, and then treated with a silicone-based oil preparation to give a processed fiber. Next, the processed fiber was dried, and then subjected to a dry-heat drawing using a heated roll with a total draw ratio of 9 to obtain an acrylic precursor fiber bundle for manufacturing carbon fiber with staple fiber denier of 0.9 dtex and 3000 filaments. Meanwhile, the depth of the horizontal flow straightening plate from the liquid surface was 50 mm, the distance between the outer periphery of the running yarn and the horizontal flow straightening plate was 30 mm, and the material of the horizontal flow straightening plate was a wire mesh manufactured by Kansai Wire Netting Co., Ltd. (30 mesh, a denier diameter of 0.18 mm, a mesh size of 0.67 mm, and a material: SUS304). The horizontal width dimension of the horizontal flow straightening plate was 100 mm in the widest region and 10 mm in the narrowest region. Top part of the vertical flow straightening plate was a plate made of SUS304 with the thickness of 2 mm and the bottom part was a wire mesh manufactured by Kansai Wire Netting Co., Ltd. (30 mesh, a line diameter of 0.18 mm, a mesh size of 0.67 mm, and a material: SUS304).

At that time, the results obtained from the vibration state of the coagulating liquid surface and the observation by an electron microscope of a cross-section of the fiber bundle which has been obtained as a drawn fiber and evaluation of the presence or absence of staple fiber adhesion based on dispersion test, and the results of analyzing maximum flow rate on the coagulating liquid surface obtained by using the numerical analysis tool are listed in Table 1.

The maximum flow rate on the liquid surface in the coagulation bath was found to be 8 cm/second based on the numerical analysis.

EXAMPLE 2

Figure 14:
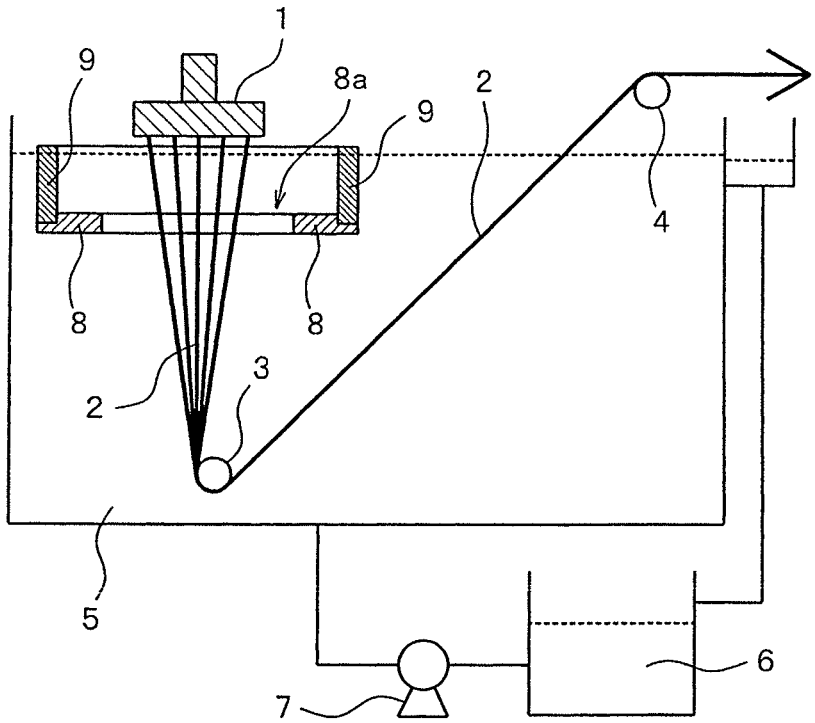
FIG. 14 is a side sectional view schematically illustrating one example of another additional embodiment of the present invention.
Figure 15:
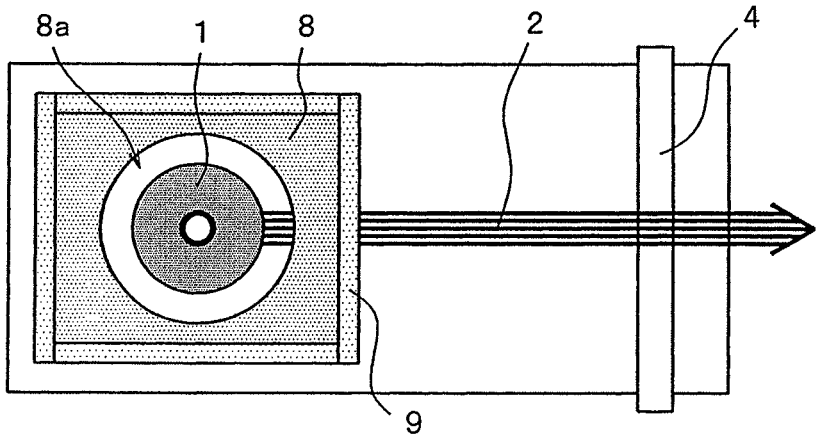
FIG. 15 is a schematic plane view of the embodiment illustrated in FIG. 14.

As illustrated in FIGS. 14 and 15, a stock solution for spinning was prepared at the same condition as Example 1 and the spinning was performed by following the same operations except that a vertical flow straightening plate extending in a downward reaction from the outer periphery of the horizontal flow straightening plate to the bottom surface of the coagulation bath is not installed. Meanwhile, the material of the vertical flow straightening plate was a wire mesh manufactured by Kansai Wire Netting Co., Ltd. (14 mesh, a line diameter of 0.29 mm, a mesh size of 1.52 mm, and a material: SUS304). The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 9 cm/second as a result of performing the same numerical analysis as Example 1.

EXAMPLE 3

Figure 8:
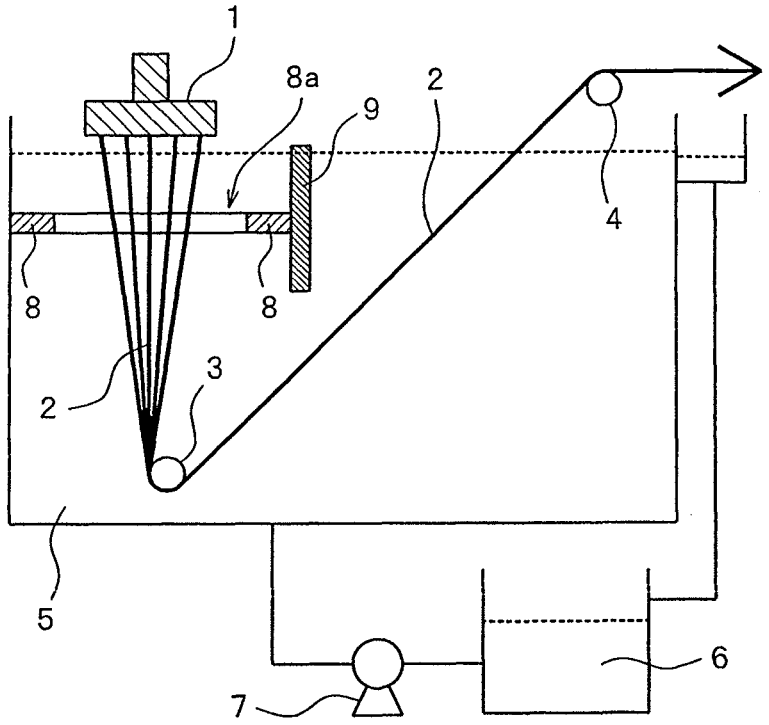
FIG. 8 is a side sectional view schematically illustrating one example of another additional embodiment of the present invention.
Figure 9:
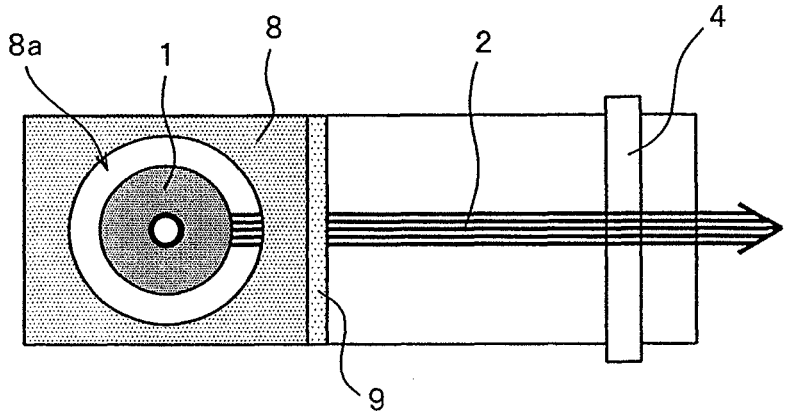
FIG. 9 is a schematic plane view of the embodiment illustrated in FIG. 8.

As illustrated in FIGS. 8 and 9, the depth of the horizontal flow straightening plate from the liquid surface was 100 mm, the distance between the outer periphery of the running yarn and the horizontal flow straightening plate was 35 mm, and the material of the horizontal flow straightening plate was a wire mesh manufactured by Kansai Wire Netting Co., Ltd. (120 mesh, a line diameter of 0.08 mm, a mesh size of 0.132 mm, and a material: SUS304). A stock solution for spinning was prepared at the same condition as Example 1 and the spinning was performed by following the same operations except that the material of the vertical flow straightening plate between the spinneret and the taking-up side guide is a wire mesh manufactured by Kansai Wire Netting Co., Ltd. (30 mesh, a line diameter of 0.18 mm, a mesh size of 0.67 mm, and a material: SUS304). The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 9 cm/second as a result of performing the same numerical analysis as Example 1.

EXAMPLE 4

Figure 10:
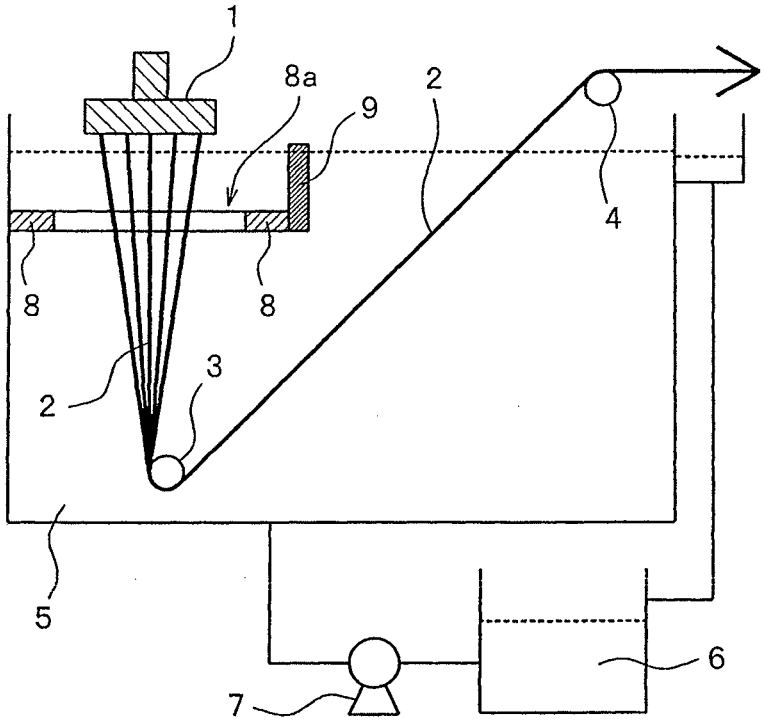
FIG. 10 is a side sectional view schematically illustrating one example of another additional embodiment of the present invention.
Figure 11:
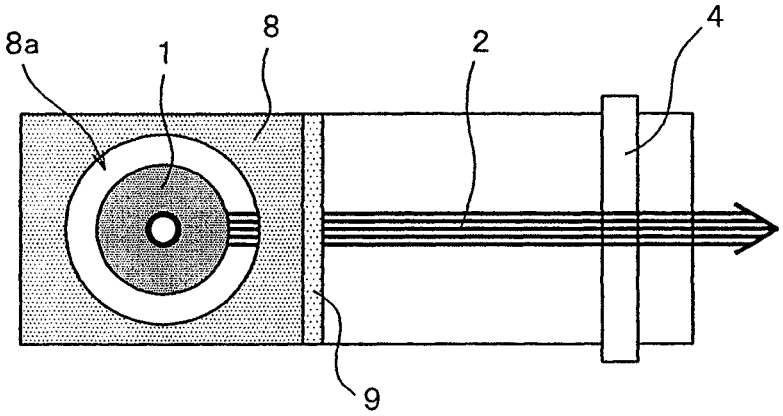
FIG. 11 is a schematic plane view of the embodiment illustrated in FIG. 10.

As illustrated in FIGS. 10 and 11, a stock solution for spinning was prepared in the same manner as Example 3 and the spinning was performed by following the same operations except that a vertical flow straightening plate extending in an upward direction from the outer periphery of the horizontal flow straightening plate to the liquid surface is installed. Meanwhile, the material of the vertical flow straightening plate was a plate made of SUS304 with the thickness of 2 mm. The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 10 cm/second as a result of performing the same numerical analysis as Example 1.

EXAMPLE 5

As illustrated in FIGS. 1 and 2, the vertical flow straightening plate was not installed but only the horizontal flow straightening plate was installed at depth of 100 mm from the liquid surface. The material of the horizontal flow straightening plate was a wire mesh manufactured by Kansai Wire Netting Co., Ltd. (30 mesh, line diameter of 0.18 mm, mesh size of 0.67 mm, and material: SUS304). A stock solution for spinning was prepared in the same manner as Example 1 and the spinning was performed by following the same operations. The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 12 cm/second as a result of performing the same numerical analysis as Example 1.

EXAMPLE 6

Figure 3:
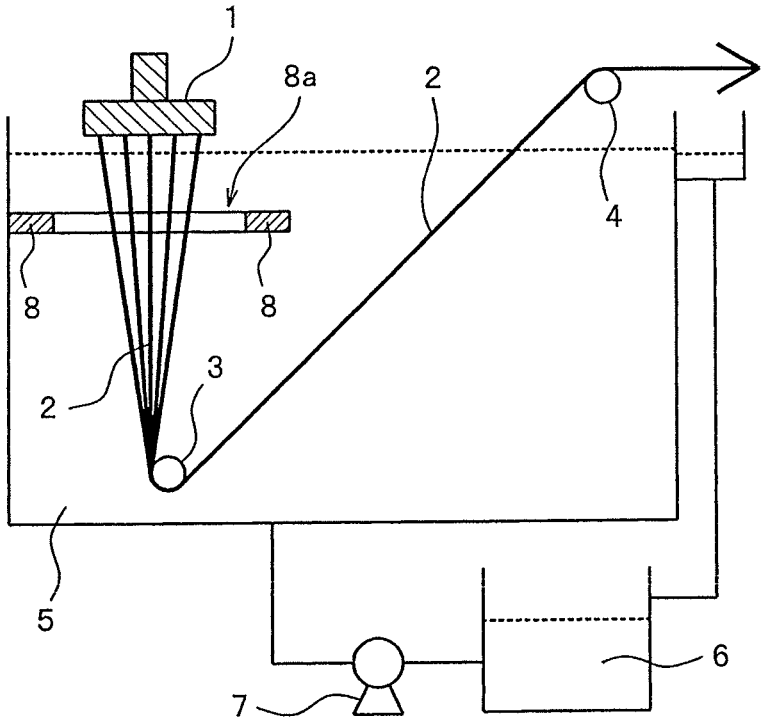
FIG. 3 is a side sectional view schematically illustrating an example of another embodiment of the present invention.
Figure 4:
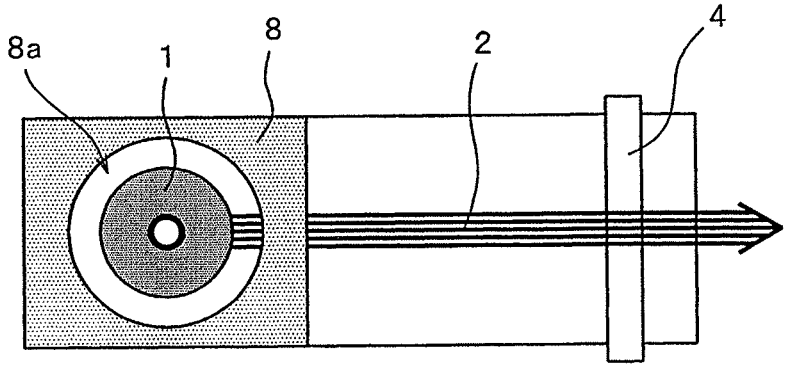
FIG. 4 is a schematic plane view of the embodiment illustrated in FIG. 3.

As illustrated in FIGS. 3 and 4, the horizontal flow straightening plate was installed at depth of 100 mm from the liquid surface. The material of the horizontal flow straightening plate was a wire mesh manufactured by Kansai Wire Netting Co., Ltd. (20 mesh, a line diameter of 0.25 mm, a mesh size of 1.02 mm, and a material: SUS304). A stock solution for spinning was prepared in the same manner as Example 1 and the spinning was performed by following the same operations. The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 13 cm/second as a result of performing the same numerical analysis as Example 1.

EXAMPLE 7

Figure 16:
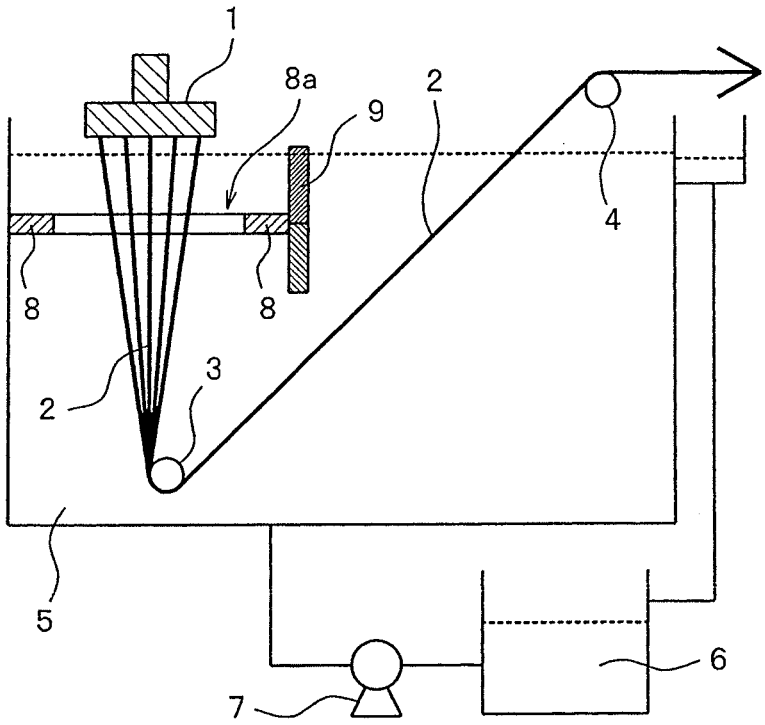
FIG. 16 is a side sectional view schematically illustrating one example of another additional embodiment of the present invention.
Figure 17:
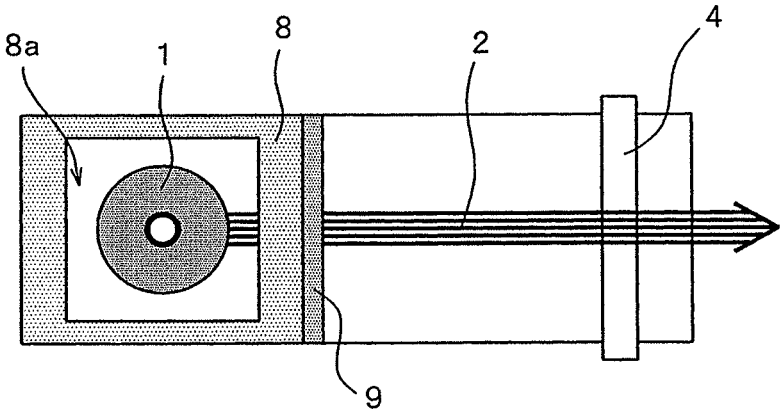
FIG. 17 is a schematic plane view of the embodiment illustrated in FIG. 16.

As illustrated in FIGS. 16 and 17, the horizontal flow straightening plate and vertical flow straightening plate were installed. The depth of the horizontal flow straightening plate from the liquid surface was 100 mm, the distance between the outer periphery of the running yarn and the horizontal flow straightening plate was 30 to 50 mm, and the material of the horizontal flow straightening plate was a wire mesh manufactured by Kansai Wire Netting Co., Ltd. (30 mesh, a line diameter of 0.18 mm, a mesh size of 0.67 mm, and a material: SUS304). As for the material of the vertical flow straightening plate between the spinneret and the taking-up side guide, the top part was a plate made of SUS304 with the thickness of 2 mm and the bottom part was a wire mesh manufactured by Kansai Wire Netting Co., Ltd. (30 mesh, a line diameter of 0.18 mm, a mesh size of 0.67 mm, and a material: SUS304), and a stock solution for spinning was prepared in the same manner as Example 1 and the spinning was performed by following the same operations. The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 9 cm/second as a result of performing the same numerical analysis as Example 1.

EXAMPLE 8

Figure 18:
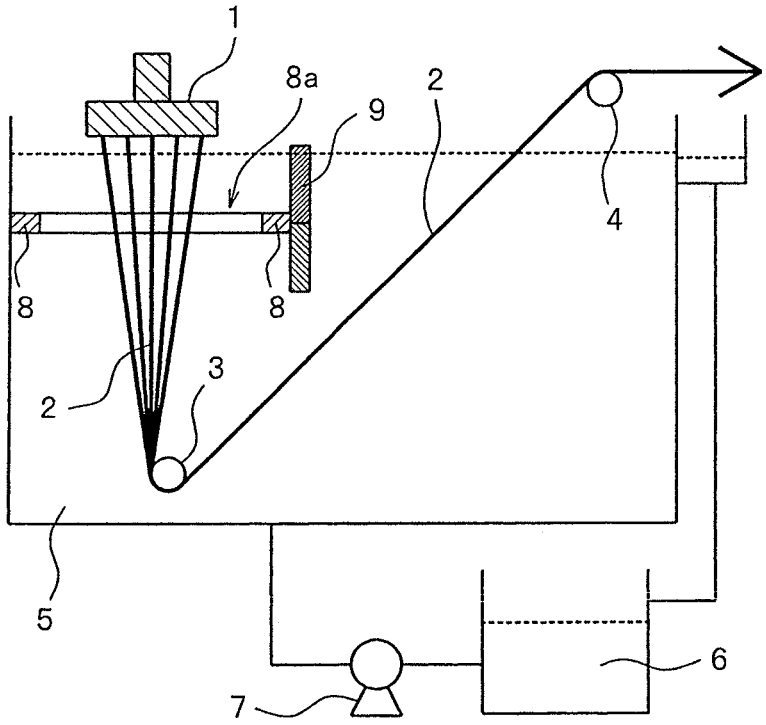
FIG. 18 is a side sectional view schematically illustrating one example of another additional embodiment of the present invention.
Figure 19:
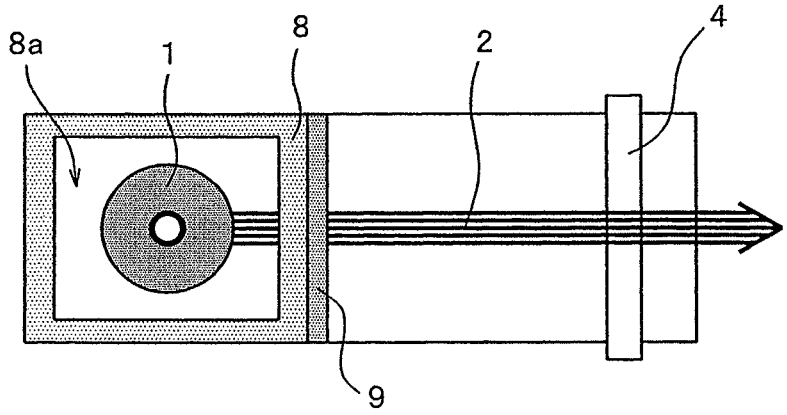
FIG. 19 is a schematic plane view of the embodiment illustrated in FIG. 18.

As illustrated in FIGS. 18 and 19, the horizontal flow straightening plate and vertical flow straightening plate were installed. The depth of the horizontal flow straightening plate from the liquid surface was 100 mm, the distance between the outer periphery of the running yarn and the horizontal flow straightening plate was 50 to 70 mm, and the material of the horizontal flow straightening plate was a wire mesh manufactured by Kansai Wire Netting Co., Ltd. (30 mesh, a line diameter of 0.18 mm, a mesh size of 0.67 mm, and a material: SUS304). As for the material of the vertical flow straightening plate between the spinneret and the taking-up side guide, the top part was a plate made of SUS304 with the thickness of 2 mm and the bottom part was a wire mesh manufactured by Kansai Wire Netting Co., Ltd. (30 mesh, a line diameter of 0.18 mm, a mesh size of 0.67 mm, and a material: SUS304), and a stock solution for spinning was prepared in the same manner as Example 1 and the spinning was performed by following the same operations. The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 10 cm/second as a result of performing the same numerical analysis as Example 1.

EXAMPLE 9

Figure 20:
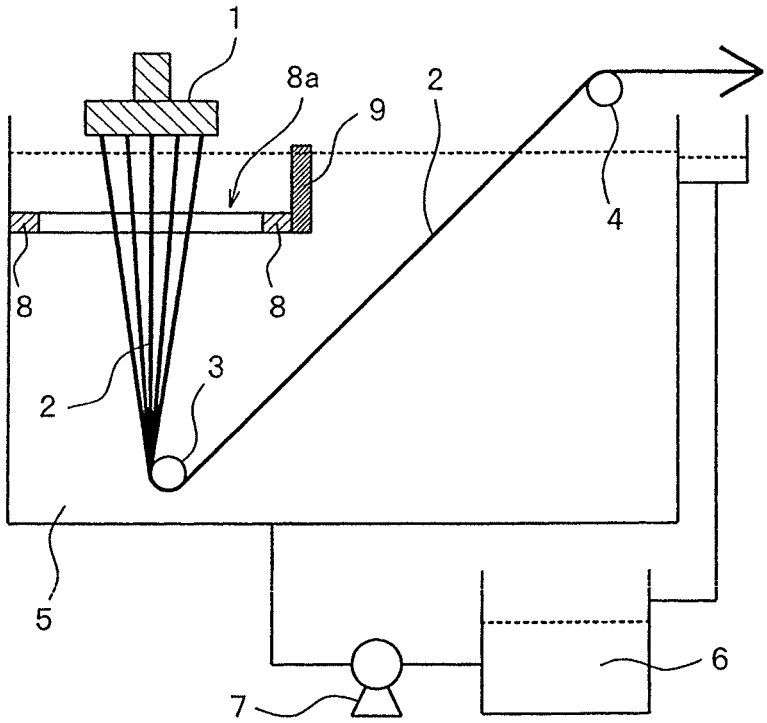
FIG. 20 is a side sectional view schematically illustrating one example of another additional embodiment of the present invention.
Figure 21:
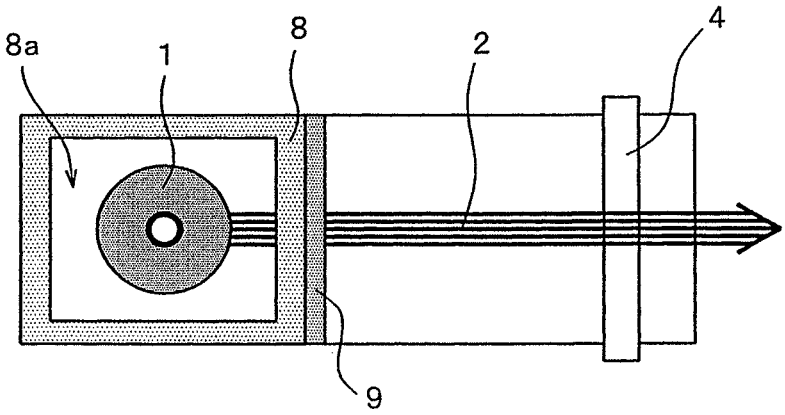
FIG. 21 is a schematic plane view of the embodiment illustrated in FIG. 20.

As illustrated in FIGS. 20 and 21, the horizontal flow straightening plate and vertical flow straightening plate were installed. The depth of the horizontal flow straightening plate from the liquid surface was 100 mm, the distance between the outer periphery of the running yarn and the horizontal flow straightening plate was 50 to 70 mm, and the material of the horizontal flow straightening plate was a wire mesh manufactured by Kansai Wire Netting Co., Ltd. (30 mesh, a line diameter of 0.18 mm, a mesh size of 0.67 mm, and a material: SUS304). The material of the vertical flow straightening plate between the spinneret and the taking-up side guide was a plate made of SUS304 with the thickness of 2 mm, and a stock solution for spinning was prepared in the same manner as Example 1 and the spinning was performed by following the same operations. The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 10 cm/second as a result of performing the same numerical analysis as Example 1.

COMPARATIVE EXAMPLE 1

Figure 22:
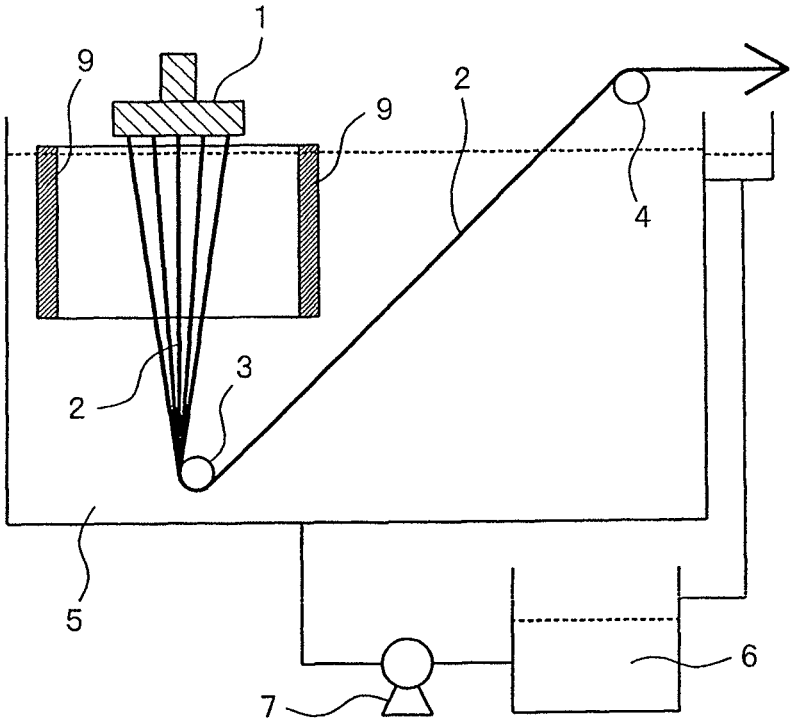
FIG. 22 is a side sectional view schematically illustrating one example of a dry-wet spinning device of a related art.
Figure 23:
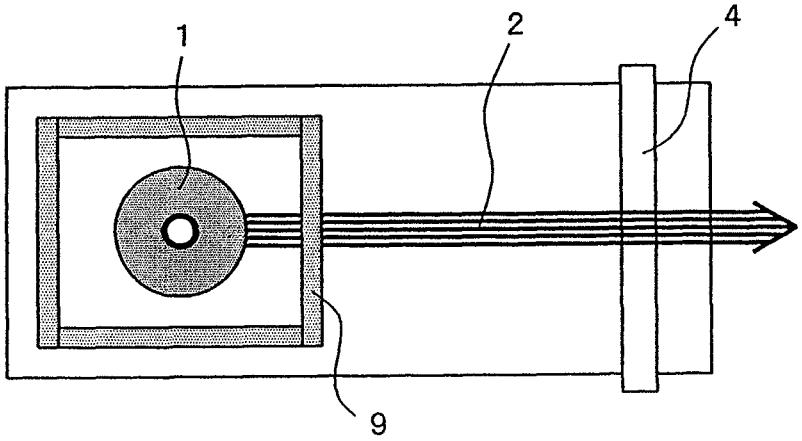
FIG. 23 is a schematic plane view of the device of a related art illustrated in FIG. 22.

As illustrated in FIGS. 22 and 23, a stock solution for spinning was prepared in the same manner as Example 1 and the spinning was performed by following the same operations except that a horizontal flow straightening plate is not installed in the coagulation bath and a rectangular cylinder-shaped vertical flow straightening plate made of SUS304 with the thickness of 2 mm is installed.

The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 17 cm/second as a result of performing the same numerical analysis as Example 1.

COMPARATIVE EXAMPLE 2

Figure 24:
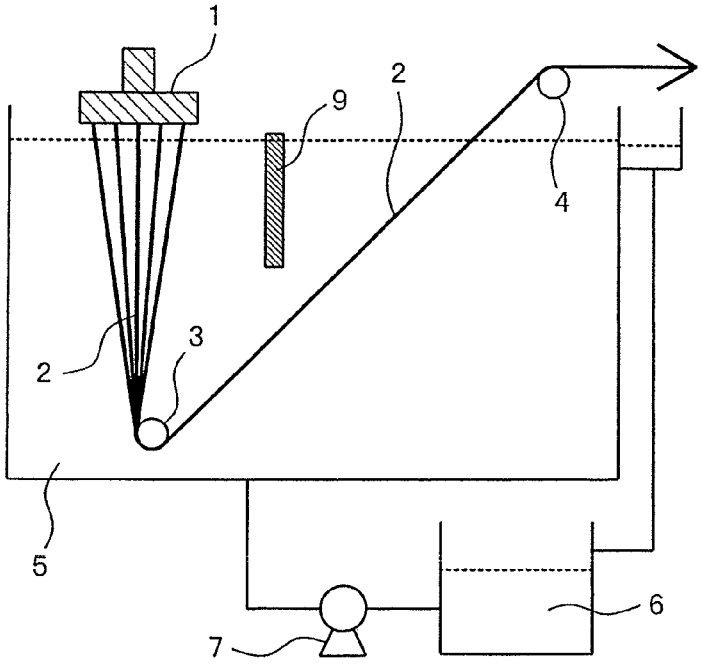
FIG. 24 is a side sectional view schematically illustrating another example of a dry-wet spinning device of a related art.
Figure 25:
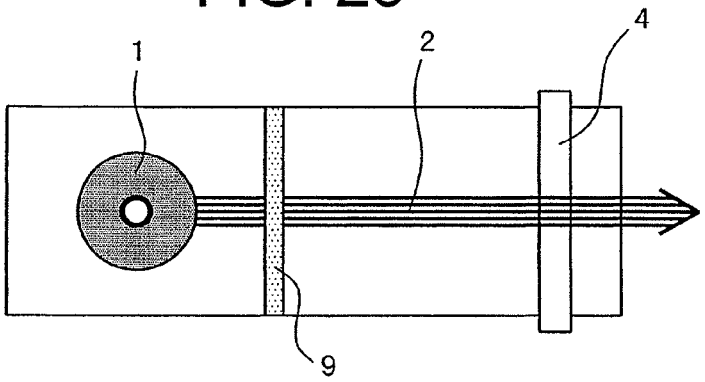
FIG. 25 is a schematic plane view of the device of a related art illustrated in FIG. 24.

As illustrated in FIGS. 24 and 25, a horizontal flow straightening plate was not installed in the coagulation bath and a vertical flow straightening plate was installed between the spinneret and the taking-up side guide. The material of the entire surface of the vertical flow straightening plate was a wire mesh manufactured by Kansai Wire Netting Co., Ltd. (30 mesh, a line diameter of 0.18 mm, a mesh size of 0.67 mm, and a material: SUS304), and a stock solution for spinning was prepared in the same manner as Example 1 and the spinning was performed by following the same operations.

The results obtained from the vibration state of the coagulating liquid surface and the observation by an electron microscope of a cross-section of the fiber bundle which has been obtained as a drawn fiber, and the evaluation of the presence or absence of staple fiber adhesion based on dispersion test are listed in Table 1.

Further, the maximum flow rate on the liquid surface in the coagulation bath was found to be 18 cm/second as a result of performing the same numerical analysis as Example 1.

EXAMPLE 10

As illustrated in FIG. 5, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn and the running yarn range of 90% surrounded by the horizontal flow straightening plate, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 13 cm/second.

EXAMPLE 11

As illustrated in FIG. 6, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn and the running yarn range of 80% surrounded by the horizontal flow straightening plate, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 14 cm/second.

EXAMPLE 12

As illustrated in FIG. 7, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn, dividing the running yarn range surrounded by the horizontal flow straightening plate into 16 sections, and installing a horizontal flow straightening plate at a ratio of 50%, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 13 cm/second.

COMPARATIVE EXAMPLE 3

Figure 26:
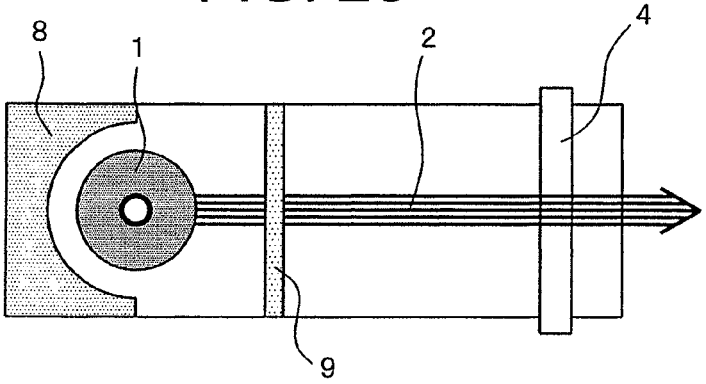
FIG. 26 is a schematic plane view illustrating Comparative Example of the present invention.

As illustrated in FIG. 26, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn and the running yarn range of 50% surrounded by the horizontal flow straightening plate, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 26 cm/second, indicating a deterioration compared to the numerical analysis result of Comparative Example 1 (17 cm/second) in which thread adhesion number was high according to the electron microscope observation and dispersion test.

EXAMPLE 13

Figure 27:
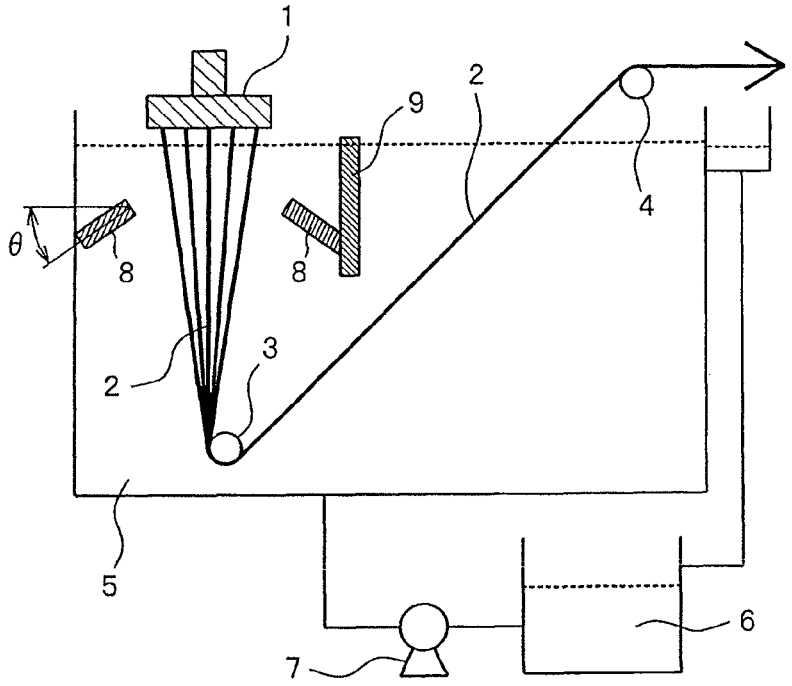
FIG. 27 is a side sectional view schematically illustrating one example of another additional embodiment of the present invention.

As illustrated in FIG. 27, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn and the upward projection angle of 45 degrees for mounting the horizontal flow straightening plate, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 10 cm/second.

EXAMPLE 14

Figure 28:
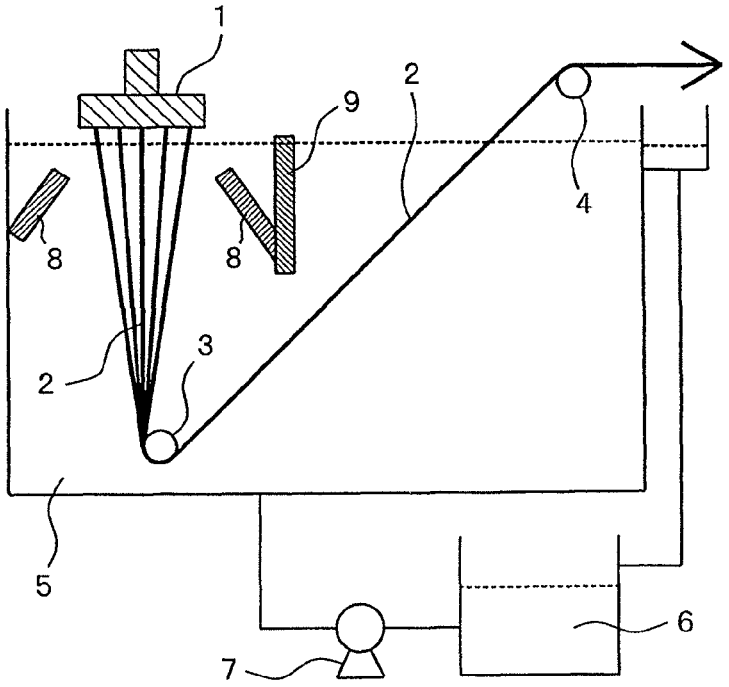
FIG. 28 is a side sectional view schematically illustrating one example of another additional embodiment of the present invention.

As illustrated in FIG. 28, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn and the upward projection angle of 75 degrees for mounting the horizontal flow straightening plate, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 12 cm/second.

COMPARATIVE EXAMPLE 4

Figure 29:
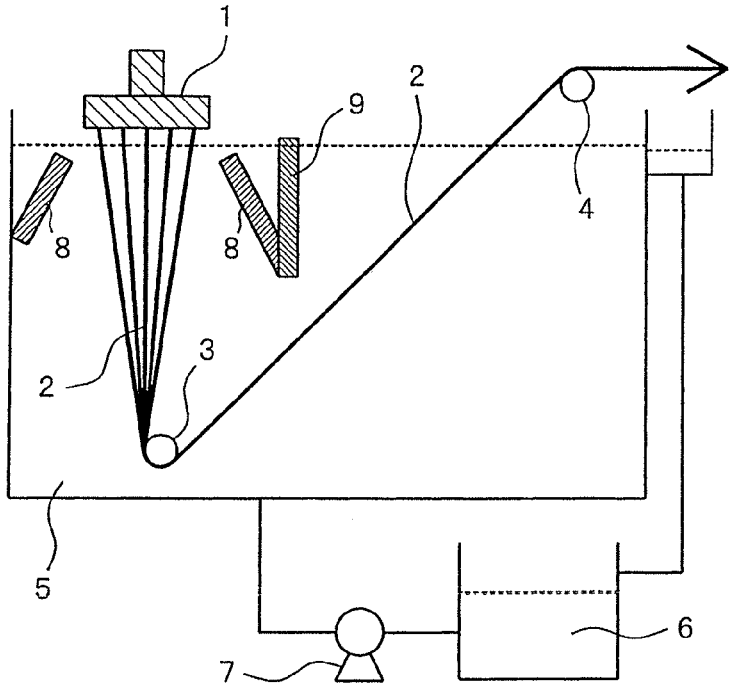
FIG. 29 is a side sectional view schematically illustrating one example of Comparative Example of the present invention.

As illustrated in FIG. 29, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn and the upward projection angle of 80 degrees for mounting the horizontal flow straightening plate, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 17 cm/second.

EXAMPLE 15

Figure 30:
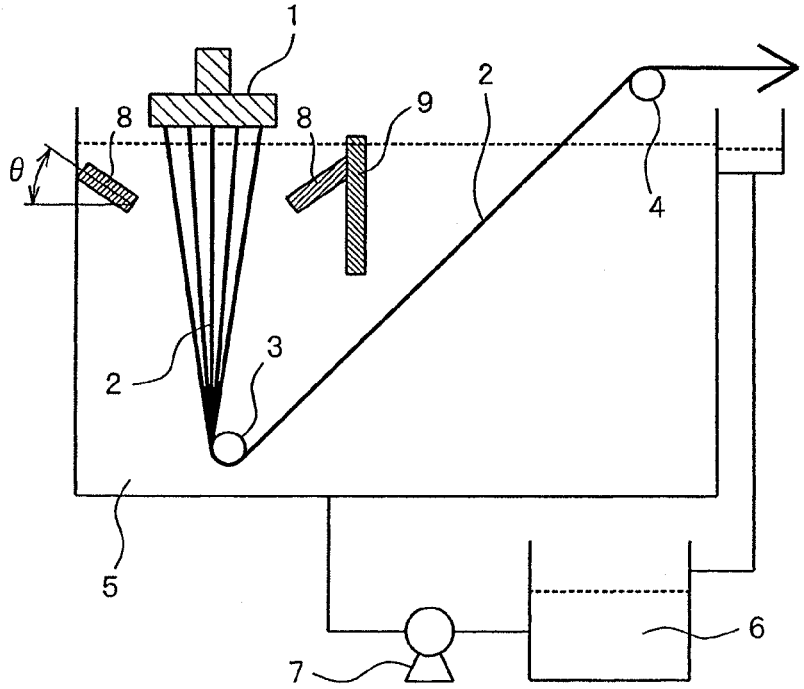
FIG. 30 is a side sectional view schematically illustrating one example of another additional embodiment of the present invention.

As illustrated in FIG. 30, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn and the downward projection angle of 45 degrees for mounting the horizontal flow straightening plate, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 12 cm/second.

EXAMPLE 16

Figure 31:
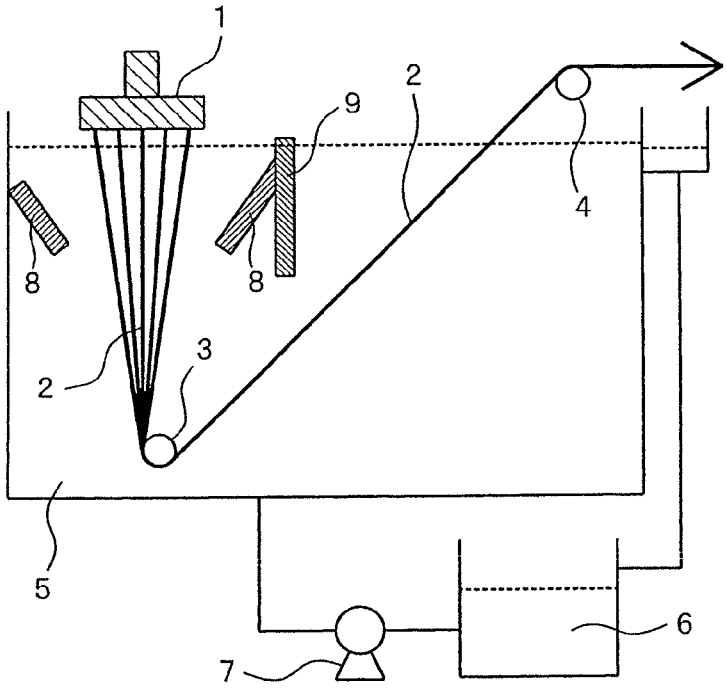
FIG. 31 is a side sectional view schematically illustrating one example of another additional embodiment of the present invention.

As illustrated in FIG. 31, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn and the downward projection angle of 75 degrees for mounting the horizontal flow straightening plate, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 13 cm/second.

COMPARATIVE EXAMPLE 5

Figure 32:
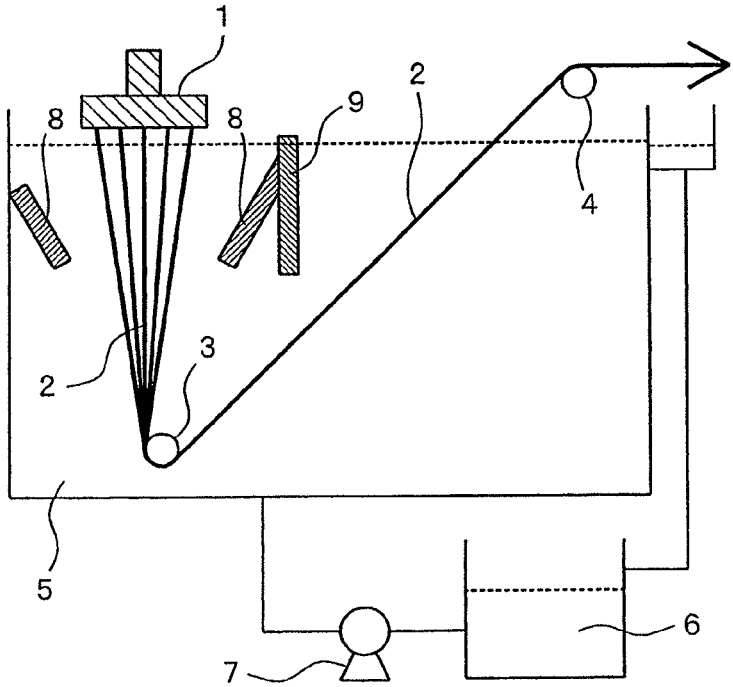
FIG. 32 is a side sectional view schematically illustrating one example of Comparative Example of the present invention.

As illustrated in FIG. 32, the depth of the horizontal flow straightening plate was 100 mm from the liquid surface. The material and horizontal width dimension of the horizontal flow straightening plate are the same as those of Example 1. By having the distance of 30 mm between the horizontal flow straightening plate and the yarn and the downward projection angle of 80 degrees for mounting the horizontal flow straightening plate, a stock solution for spinning was prepared in the same manner as Example 1 and the spinning was performed by following the same operations. After that, as a result of performing the same numerical analysis as Example 1, the maximum flow rate on the liquid surface in the coagulation bath was found to be 20 cm/second.

TABLE 1

Figure 12:
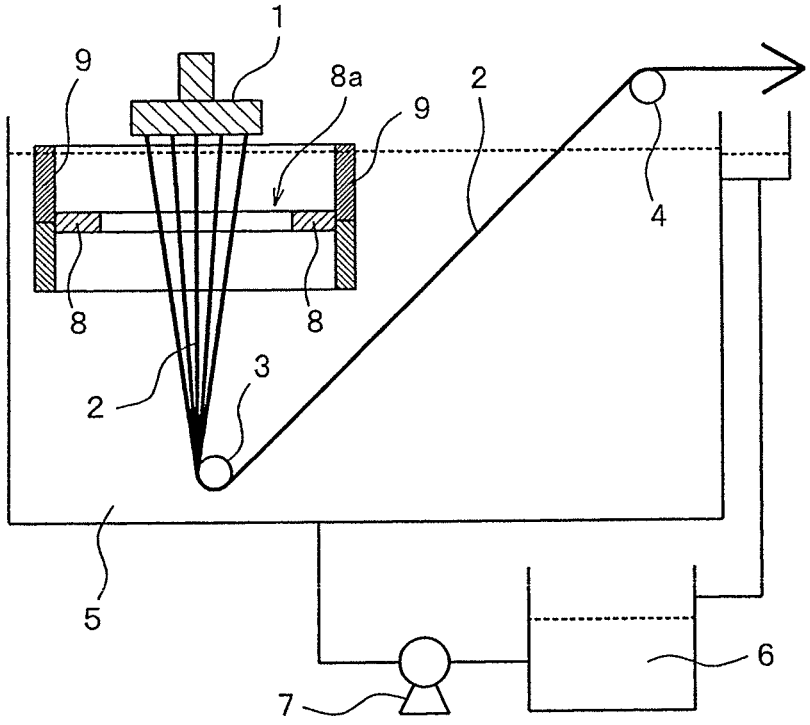
FIG. 12 is a side sectional view schematically illustrating one example of another additional embodiment of the present invention.
Figure 13:
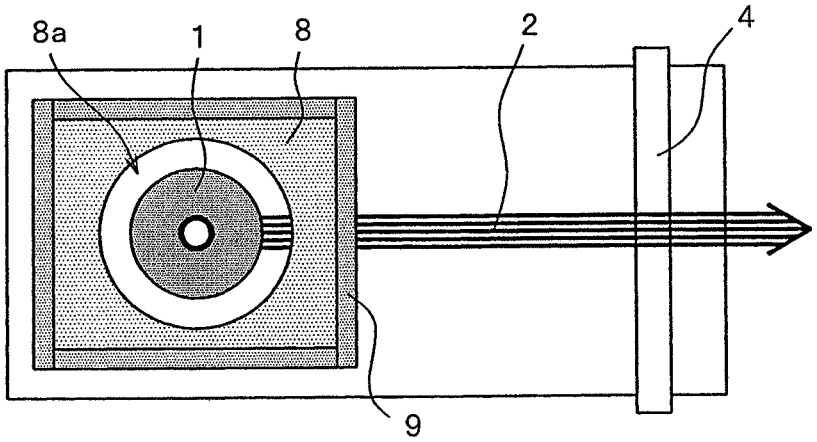
FIG. 13 is a schematic plane view of the embodiment illustrated in FIG. 12.

| | | Representative Embodiments | | | | | | | | | Comparative | Comparative |
|---|---|---|---|---|---|---|---|---|---|---|---|---|
| | | Example 1 | Example 2 | Example 3 | Example 4 | Example 5 | Example 6 | Example 7 | Example 8 | Example 9 | Example 1 | Example 2 |
| | | FIGS. 12 and 13 | FIGS. 14 and 15 | FIGS. 8 and 9 | FIGS. 10 and 11 | FIGS. 1 and 2 | FIGS. 3 and 4 | FIGS. 16 and 17 | FIGS. 18 and 19 | FIGS. 20 and 21 | FIGS. 22 and 23 | FIGS. 24 and 25 |
| Horizontal flow straightening plate | Horizontal width dimension (mm) | 10-100 mm | 10-100 mm | Extended to wall surface | Extended to wall surface | 10-100 mm | Extended to wall surface | Extended to wall surface | Extended to wall surface | Extended to wall surface | No | No |
| | mesh | 30 | 30 | 120 | 120 | 30 | 20 | 30 | 30 | 30 | | |
| Range of yarn surrounded by horizontal flow straightening | Ratio (%) | 100 | 100 | 100 | 100 | 100 | 100 | 100 | 100 | 100 | — | — |
| Angle for mounting horizontal flow straightening plate | Angle | Parallel to water surface | Parallel to water surface | Parallel to water surface | Parallel to water surface | Parallel to water surface | Parallel to water surface | Parallel to water surface | Parallel to water surface | Parallel to water surface | — | — |
| Depth for installing horizontal flow straightening plate | (mm) | 50 | 50 | 100 | 100 | 100 | 100 | 100 | 100 | 100 | — | — |
| Distance between horizontal flow straightening plate and yarn x | (mm) | 30 | 30 | 35 | 35 | 35 | 35 | 30-50 | 50-70 | 50-70 | — | — |
| Vertical flow straightening plate | Configuration, material | Top part Plate | Top part 14 mesh | Entire surface | Top part Plate | — | — | Top part Plate | Top part Plate | Top part Plate | Plate | 30 mesh |
| | | Bottom part 30 mesh | — | 30 mesh | — | — | — | Bottom part 30 mesh | Bottom part 30 mesh | — | | |
| Vibration of liquid surface | | ◎ | ◎ | ◎ | ◎ | ○ | ○ | ◎ | ◎ | ◎ | X | X |
| Presence or absence of staple fiber adhesion determined by electron microscope | | No | No | No | No | No | No | No | No | No | Yes | Yes |
| Number of staple fiber adhesion determined by dispersion test | | 0 | 0 | 0 | 0 | 1 | 1 | 0 | 0 | 0 | 20 | 30 |
| Maximum flow rate on coagulating liquid surface determined by numeral analysis | (cm/second) | 8 | 9 | 9 | 10 | 12 | 13 | 9 | 10 | 10 | 17 | 18 |

TABLE 2

| | Example 10 FIG. 5 | Example 11 FIG. 6 | Example 12 FIG. 7 | Comparative Example 3 FIG. 26 | Example 13 FIG. 27 | Example 14 FIG. 28 | Comparative Example 4 FIG. 29 | Example 15 FIG. 30 | Example 16 FIG. 31 | Comparative FIG. 32 |
|---|---|---|---|---|---|---|---|---|---|---|
| Horizontal width dimension (mm) | Extended to wall surface | Extended to wall surface | Extended to wall surface | Extended to wall surface | Extended to wall surface | Extended to wall surface | Extended to wall surface | Extended to wall surface | Extended to wall surface | Extended to wall surface |
| mesh | 30 | 30 | 30 | 30 | 30 | 30 | 30 | 30 | 30 | 30 |
| Ratio (%) | 90 | 80 | 50 (divided into 16) | 50 | 100 | 100 | 100 | 100 | 100 | 100 |
| Angle | Parallel to water surface | Parallel to water surface | Parallel to water surface | Parallel to water surface | Upward projection angle of 45 degrees | Upward projection angle of 75 degrees | Upward projection angle of 80 degrees | Downward projection angle of 45 degrees | Downward projection angle of 75 degrees | Downward projection angle of 80 degrees |
| (mm) | 100 | 100 | 100 | 100 | 100 | 100 | 100 | 100 | 100 | 100 |
| (mm) | 30 | 30 | 30 | 30 | 30 | 30 | 30 | 30 | 30 | 30 |
| Configuration, material | Entire surface 30 mesh | Entire surface 30 mesh | Entire surface 30 mesh | Entire surface 30 mesh | Entire surface 30 mesh | Entire surface 30 mesh | Entire surface 30 mesh | Entire surface 30 mesh | Entire surface 30 mesh | Entire surface 30 mesh |
| (cm/second) | 13 | 14 | 13 | 26 | 10 | 12 | 17 | 12 | 13 | 20 |

EXPLANATIONS OF LETTERS OR NUMERALS

1: Spinneret
2: (Spun) Yarn
3: Direction changing guide
4: Taking-up side guide
5: Coagulation bath
6: Bath for receiving coagulation discharge
7: Circulation pump
8: Horizontal flow straightening plate
8*a*: Opening part
8*b*: Connecting part
9: Vertical flow straightening plate

The invention claimed is:

1. A method for manufacturing a synthetic fiber, the method comprising:

spinning a synthetic fiber while, when stock solution for spinning is spun downward from a spinneret and discharged to a vapor phase part for forming fibers, which are then coagulated by introduction to a coagulation bath, a reflecting flow moving in an upward direction is blocked by a horizontal flow straightening plate as an accompanying flow accompanying running of a spun yarn in a downward direction is reflected by a bottom surface of the coagulation bath, wherein the horizontal flow straightening plate includes a single piece or plural pieces of plates, and has an opening part for passing the yarn at the center, and is disposed in a range of 50% or more of the circumference of the yarn spun downward from the spinneret, the opening part is connected to an outside of the horizontal flow straightening part by forming a connecting part on the horizontal flow straightening plate, and each of the openings formed by the connecting part is in a range of 20% or less of the outer periphery of the opening part.

2. The method for manufacturing the synthetic fiber according to claim 1, wherein the angle formed by a surface of the horizontal flow straightening plate and a horizontal surface in the outward direction from the coagulation bath is 75 degrees or less.

3. The method for manufacturing the synthetic fiber according to claim 1, wherein a horizontal width dimension of a plate for forming the horizontal flow straightening plate is 5 mm or more.

4. The method for manufacturing the synthetic fiber according to claim 1, wherein part or all of the horizontal flow straightening plate extends to a wall surface of a coagulation bath.

5. The method for manufacturing the synthetic fiber according to claim 1, wherein an end part of the horizontal flow straightening plate on a side closest to a yarn is installed below the liquid surface.

6. The method for manufacturing the synthetic fiber according to claim 1, wherein a distance between the end part of the horizontal flow straightening plate on a side closest to a yarn and the yarn is 5 to 100 mm.

7. The method for manufacturing the synthetic fiber according to claim 1, wherein the horizontal flow straightening plate is a porous plate.

8. The method for manufacturing the synthetic fiber according to claim 7, wherein the porous plate is a punched metal with an opening ratio of 5 to 95% and a hole diameter of 0.5 mm to 50 mm.

9. The method for manufacturing the synthetic fiber according to claim 7, wherein the porous plate is a wire mesh with a mesh size of 2 to 800 mesh.

10. The method for manufacturing the synthetic fiber according claim 1, wherein a vertical flow straightening plate made of a plate extending in an upward direction to the liquid surface on part or all of the outer periphery of the horizontal flow straightening plate is disposed.

11. The method for manufacturing the synthetic fiber according to claim 1, wherein a vertical flow straightening plate made of a plate extending in an upward direction above the liquid surface and a vertical flow straightening plate made of a plate extending in a downward direction on part or all of the outer periphery of the horizontal flow straightening plate are disposed.

12. The method for manufacturing the synthetic fiber according to claim 10, wherein the vertical flow straightening plate is a porous plate.

13. The method for manufacturing the synthetic fiber according to claim 12, wherein the vertical flow straightening plate is a punched metal with an opening ratio of 5 to 95% and a hole diameter of 0.5 mm to 50 mm, or a wire mesh with a mesh size of 2 to 800 mesh.

14. The method for manufacturing the synthetic fiber according to claim 1, wherein the horizontal flow straightening plate and/or the vertical flow straightening plate is mountable and also detachable.

* * * * *